US007001099B2

(12) United States Patent
Rittenhouse et al.

(10) Patent No.: US 7,001,099 B2
(45) Date of Patent: Feb. 21, 2006

(54) REMOTE CONTROLLED PARKING BARRIER APPARATUS

(75) Inventors: James M. Rittenhouse, Clinton, NJ (US); Rudor M. Teich, West Orange, NJ (US)

(73) Assignee: Designated Parking Corp., West Orange, NJ (US)

( * ) Notice: Subject to any disclaimer, the term of this patent is extended or adjusted under 35 U.S.C. 154(b) by 0 days.

(21) Appl. No.: 10/728,668

(22) Filed: Dec. 4, 2003

(65) Prior Publication Data

US 2004/0165949 A1 Aug. 26, 2004

Related U.S. Application Data

(60) Provisional application No. 60/431,969, filed on Dec. 10, 2002.

(51) Int. Cl.
*E01F 13/00* (2006.01)

(52) U.S. Cl. ..... 404/6; 404/9; 49/49

(58) Field of Classification Search ..... 404/6, 404/9, 10; 256/13.1; 116/63 R; 49/49
See application file for complete search history.

(56) References Cited

U.S. PATENT DOCUMENTS

| | | | | |
|---|---|---|---|---|
| 3,849,936 | A * | 11/1974 | Geraci | 49/35 |
| 4,875,797 | A * | 10/1989 | Hartwig | 404/9 |
| 4,886,232 | A * | 12/1989 | Dicke et al. | 248/576 |
| 5,228,237 | A * | 7/1993 | Nasatka | 49/49 |
| 6,150,958 | A * | 11/2000 | Worsham | 340/932.2 |
| 6,398,452 | B1 * | 6/2002 | Wagner et al. | 404/6 |
| 6,619,629 | B1 * | 9/2003 | Boswell | 256/13.1 |

* cited by examiner

*Primary Examiner*—Raymond W. Addie
(74) *Attorney, Agent, or Firm*—Gottlieb, Rackman & Reisman, P.C.

(57) ABSTRACT

A barrier for the control of access of vehicles through a roadway, which uses stored mechanical energy to place the barrier in one of three states, one a blocking position and two non-blocking positions. The mechanical energy is derived from the weight of the vehicle as it passes over the apparatus. The activation of the barrier can be controlled by remote control at will, time-independent from the passing of the vehicle over the apparatus.

33 Claims, 9 Drawing Sheets

REMOTE CONTROLLED PARKING BARRIER APPARATUS

This application claims the benefits of Provisional Patent Application Ser. No. 60/431,969 filed on Dec. 10, 2002.

BACKGROUND OF THE INVENTION

1. Field of the Invention

The present invention is related to moveable barriers that control, or direct, access by vehicles to a parking space where the vehicle drives in, and backs out. The invention is also suitable for moveable barriers that control, or direct, access by vehicles to parking areas or driveways where the vehicle drives through the moveable barrier if access is granted. More particularly, the invention addresses a mechanically-actuated barrier which can be controlled remotely and which is mounted directly to the roadbed.

2. Description of Prior Art

Electrically actuated gates, garage doors and similar barrier systems are now commonplace. There are numerous applications, however, where electrically powered barriers are not practically feasible. An example of such an application is the head of a driveway where no electricity is available. Another example is a parking spot in a multi-dwelling parking lot.

A battery-operated parking barrier is disclosed in U.S. Pat. No. 6,150,958 to Worsham. The apparatus works in a manner similar to remote-controlled garage door operators, with a barrier impeding access to a parking spot when the apparatus is set to block access. The barrier is actuated by an electric motor which powered by a rechargeable battery. The battery is charged by a solar panel. The Worsham system requires a complex mechanism, a heavy and expensive battery and a solar panel for charging that is ineffective in indoor applications.

A number of mechanically-actuated barriers have been previously disclosed. One system disclosed in U.S. Pat. No. 5,146,710 to Caldwell describes a mechanism for controlling access to a parking spot. Two pivoted plates are installed in the parking space, distanced from each other so that one plate can be engaged by the front wheel of the vehicle even as the barrier is in the blocking position. The second plate is installed so that it can only be accessed by the front wheel if the barrier is retracted, allowing full access to the parking space. The two plates are mechanically linked to create action akin to a see-saw, with one plate always protruding and one horizontal. The Caldwell barrier drops by its own weight when released by the driver to gain access to the parking space. As the car drives over the second plate, the weight of the wheel forces the plate to a horizontal position, and through a linkage, it forces the first plate (which is now behind the front wheels of the vehicle) to rise from its horizontal position. As the car pulls back to leave the parking space and the front wheel engages the first plate, the motion of the pivoting first plate is used to raise the barrier. The limitations of the Caldwell system lie in the complexity and cost of the product and its installation. The system comprises a number of separate assemblies that must be installed in the driveway, with mechanical linkages to interconnect them. In addition to the cost, such a method is likely to be unreliable when used in outdoor applications, subject to rust and debris. The Caldwell system also dictates that the barrier is always raised when the car leaves the spot. This may not be desirable, for example when the spot is to be left accessible for a visitor that may not have the key required to unlock the barrier. The Caldwell system is not suitable for drive-through applications, because once the vehicle passes over the retracted front plate, having the rear wheel engage the rear plate will force the barrier to extend into the blocking position while the vehicle is still over the barrier.

Another example of the prior art is U.S. Pat. No. 5,165,200 to Oga which describes a mechanically actuated parking space barrier where the motive force to displace the barrier is provided by pushing the barrier with the bumper of the car. The Oga system stores the energy to return the barrier to its frontal blocking position in a spring. Such an arrangement can store dangerous levels of potential energy, and hurt a person if the barrier is temporarily stuck in its retracted position after the car has departed. The system also requires mounting a rail or cable guide to keep the barrier on a track when it is being pushed back by the car. A further limitation of the system is the reluctance of drivers to push any item with the bumpers, and the likelihood of some car designs to cause marring of the car's grille by repeated engagement of the barrier.

The patent to Sayers, U.S. Pat. No. 5,299,882, discloses a gate that is mechanically operated. The gate is opened by a spring. The gate is closed by a depressible pedal that is actuated by the vehicle's weight. The Sayers system operates similarly to the Caldwell system, except that a spring provides the force to open the gate, whereas gravity is used to retract the barrier in the Caldwell invention. The Sayers system is applicable to gates that rotate on a vertical axis. It requires a considerable investment in the structure and construction of a gate, and is not suitable as a parking space barrier.

Moreover, in both the Sayers and Caldwell systems, the plate that is responsive to the weight of the car needs to be placed a significant distance away from the gate or barrier, as it closes the gate or barrier while the car weight is on the plate. Thus, the pedal must be positioned away from the gate or barrier a distance which exceeds the distance between the wheel of the vehicle and the vehicle's extremity (e.g., the front or rear bumper of the vehicle). Otherwise, when the wheel passes over the pedal and the gate or barrier is raised, the gate or barrier would hit the underside of the vehicle. For commercial vehicles (e.g., trash haulers, etc.), this distance may be in excess of twenty feet, making the Sayers or Caldwell systems impractical for these applications.

The patent to Trougouboff, U.S. Pat. No. 5,452,964, discloses a mechanical barrier with elastic spring to protect the barrier from accidental bumping by the car. The Trougouboff system does not offer remote control capability and requires manual release of the barrier.

U.S. Pat. No. 6,398,452 to Wagner et al. discloses a remote controlled barrier that is mechanically actuated. The device comprises a separate barrier and a separate pedal, both moveable around horizontal shafts but having different degrees of angular rotation allowed for each. The device has 3 states of operation: Disarmed, Armed and Blocking.

In the Disarmed state, the barrier is essentially horizontal and is locked in that position. The pedal is held in a slightly elevated state by a torsion spring. The device changes from the Disarmed state to an Armed state when a car drives over the pedal. The weight of the wheel against the pedal depresses the torsion spring and forces the pedal to an essentially horizontal position, where it is locked to the barrier.

In the Armed position, the pedal and the barrier are essentially horizontal, locked to each other and locked against movement in reference to the housing of the device. The device changes from the Armed state to the Blocking state when a command releases the latch that holds the barrier from rotating. The barrier and the pedal rotate to their respective raised positions, propelled by the torsion spring.

In the Blocking state, the barrier and the pedal are raised and locked against movement. The barrier, when in Blocking state, is raised through rotation to an essentially vertical position, to impeded the passage of a vehicle. The pedal is a metal flap that, when in the Blocking state, is raised somewhat from its resting horizontal position.

The Wagner system has a number of significant shortcomings. The design necessitates a side-by-side arrangement of the barrier and the pedal. This in turn means that the length of both the barrier and the pedal must be reduced as their sum total length is dictated by practical considerations of the total length of the device. The relatively short pedal therefore requires the driver to aim the wheel of the car to engage the pedal as the car is driven in (with the device in the Disarmed state). This is particularly demanding when the car is driven to a typical parking spot, where the car often needs to make a sharp turn to enter the spot from an access lane.

Another limitation of the Wagner system is its vulnerability to accidental or intentional abuse. Due to the narrow width of the pedal, the device must be installed close to the edge of the parking spot, so that the right front tire of the oncoming vehicle will engage the pedal as the car drives in when the device is in the Disarmed state. When in the Blocked state, the section of the device that is occupied by the pedal does not block relatively small vehicles from passing over the pedal, as long as the vehicle avoids the raised barrier next to the pedal. Furthermore, if a car attempts to park at an adjacent parking spot on the right and it overshoots its boundary, as is often the case when cars enter from a perpendicular narrow lane, one of the tires is likely to ride over the pedal. The locking mechanism associated with the pedal thus needs to withstand the full weight that rides on that tire, which is typically 1,000 lbs. Such repeated abuse is likely to either deform the pedal or damage the mechanism.

Yet another limitation of the Wagner system is that it requires a slot opening to the housing that contains the mechanism and its electronics. The parking device is installed on the pavement where it will be subjected to rain, standing water, salt and other environmentally hostile contaminants. Sealing a slot is practically cost prohibitive, presenting a serious issue of long term reliability of such a system.

In our co-pending application, Ser. No. 02/20626 filed Jun. 28, 2002, we disclose a remote controlled parking barrier which comprises a flag and a separate pedal. The flag acts as a signal post to indicate that the parking space is reserved and is not to be occupied by unauthorized drivers. Under remote command, a latch is released and the flag falls from its own weight to a horizontal position to allow access. In the process of the flag falling, the pedal is raised slightly. As the authorized car drives over the apparatus and over the pedal, the pedal is compressed and the energy is stored in a spring assembly. Both the pedal and the flag are locked in their respective positions. When a remote command is received, the flag lock is released and the stored energy in the spring is released to raise the flag back to its vertical, impede position.

The key shortcoming of said design (along with the fact that a separate pedal is used) is the mechanical limitations of the flag, preventing it from acting as a real threat to impede access. Due to the flag's long arm, the flag's weight translates to a significant torque requirement on the shaft of the flag. The torque required to raise the flag places a significant strain on the mechanical design, requiring heavy spring and a heavy mechanical construction. This raises the weight and cost of the unit significantly in direct relation to the weight of the flag. Practical considerations limit the weight of the flag to a light plastic tube. This in turn restricts the effectiveness of the flag to act as a barrier.

In view of the above limitations of the current art, all the above solutions have a limited commercial appeal.

It is one object of our invention to provide a remote controlled parking barrier that overcomes the shortcomings of the prior art.

It is another object of our invention to provide an economical and effective fully remote controlled barrier that can be mass produced, where the active mechanism can be manufactured as a single assembly that is relatively compact, can be attached to the surface of a roadway, can be used for both parking space access control and for drive-through access control, and that requires no external electrical power to operate.

Another object of the invention is to offer a solution to drive-through access control which works equally well regardless of the direction of the vehicle's approach to the barrier.

SUMMARY OF THE INVENTION

The present invention is of a barrier system where a full width barrier, moves between a first generally vertical position where the barrier impedes vehicular traffic through the system, a second generally horizontal position where the barrier permits the vehicle to pass over the barrier, and a third generally retracted position which also permits unimpeded vehicle traffic by way of a motive assembly. The barrier, which also acts as a pedal, is an elongated metal profile that rotates on a horizontal axis to rise vertically to impede the traffic. The need for a separate pedal is eliminated. By having a single barrier and no pedal, extra moving parts are eliminated and the system may be weather sealed relatively easily. Moreover, since the motive assembly is contained in a single housing, the barrier may be easily changed or replaced, as required without affecting the motive assembly. The apparatus housing is designed with a low profile, to allow any vehicle to pass over the bump created by the apparatus, without damage to its undercarriage.

In one preferred embodiment, the barrier is held in the impeding position through a mechanical locking mechanism. When it is desired by an authorized user of the system to remove the barrier impediment, the locking mechanism is released electrically. The barrier rotates to the un-impeding position essentially through the force of gravity, which tends to bias the barrier to move to this unimpeding position. The barrier is prevented from falling beyond a certain shallow angle by a spring forming part of a motive assembly, but still allows travel by a vehicle over the barrier system. As the vehicle passes over the barrier, the slightly raised barrier is depressed by the force exerted on it by the vehicle's tire. The movement of the barrier stores mechanical energy in the spring, and the barrier is now locked in the fully retracted position. This state can be maintained indefinitely allowing the barrier to be left in the retracted position long after the vehicle has left the barrier's area, e.g., with the vehicle in the allowed parking spot. The stored mechanical energy is adequate to raise the barrier to its impede position. When it is desirable to set the barrier back to the impede position, the lock that holds the barrier is released. The barrier is then driven by the spring and is returned to the impede position.

The electro-mechanical locking mechanism that holds the barrier in the two positions can be controlled by a radio remote control, or other limited-access methods known in the art such as key-operated switches.

Thus, the present invention provides an apparatus for controlling access of a vehicle past a barrier comprising a barrier movable between a first ("Horizontal") barrier position allowing transit of the vehicle past said barrier with the barrier being slightly elevated, a second ("Ramp") barrier position immediately following the passage of a vehicle over the barrier whereby the barrier is fully retracted, and a third ("Vertical") barrier position preventing transit of the vehicle past said barrier, said barrier being normally biased to move to said first barrier position; a locking mechanism for maintaining said barrier in said second barrier position or in said third barrier position; and an energy storage assembly which stores mechanical energy to eventually move said barrier from said second barrier position to said third barrier position, said energy storage assembly eventually moving said barrier with sufficient force to enable said barrier to overcome said barrier bias.

BRIEF DESCRIPTION OF THE DRAWINGS

For a more complete understanding of the invention, reference is made to the following description, when taken in connection with the following drawings, wherein.

DETAILED DESCRIPTION OF THE PREFERRED EMBODIMENT

Figures 1A, 1B, 1C:
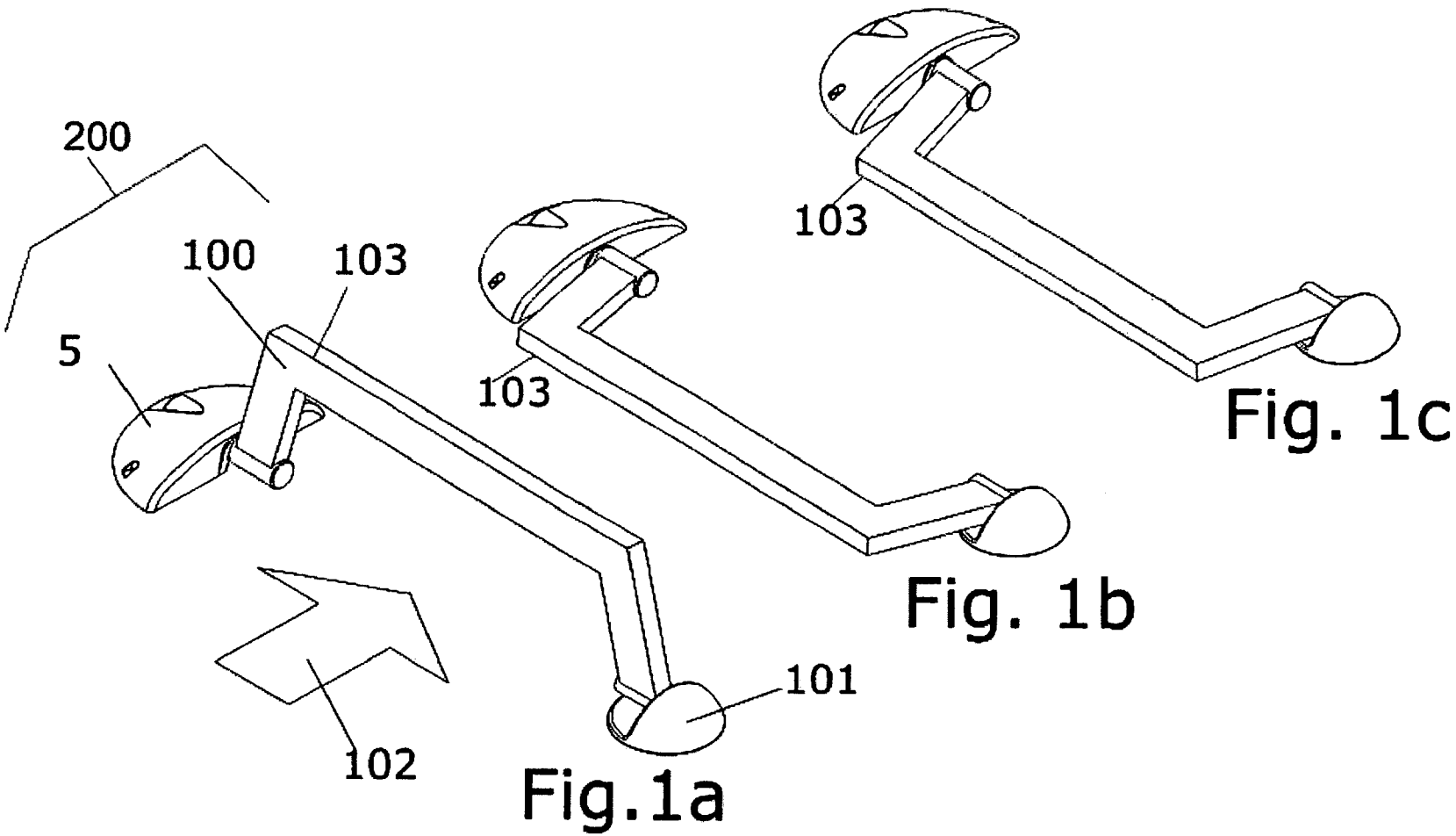
FIG. 1*a* is a perspective view of the parking barrier apparatus, according to our invention, with the barrier in its Vertical position.
FIG. 1*b* is a perspective view of the parking barrier apparatus with the barrier in its Horizontal position.
FIG. 1*c* is a perspective view of the parking barrier apparatus with the barrier in its Ramp position.

FIG. 1*a* shows the main elements of a parking barrier apparatus generally designated 200. The apparatus 200 includes a mechanical assembly 5 (including a latch or locking mechanisms and a motive assembly, to be described), a movable barrier 100 and bearing assembly 101. Barrier 100 is supported by bearing assembly 101 on one side, and by mechanical assembly 5 on its other side. Barrier 100 is free to rotate on the bearing assembly end, but is rotationally attached to an output shaft 1 (see FIG. 2) of the mechanical assembly 5. Barrier 100 therefore can only rotate when shaft 1 is rotating. Both mechanical assembly 5 and bearing assembly 101 are of a low profile, allowing the vehicle to pass over them.

FIG. 1*a* shows the barrier parking apparatus 200 with the barrier in the impede mode. This state of the barrier will be referred to as Vertical. As will be explained, in this state, barrier 100 is prevented from moving backwards (away from the approaching car 102) or down (to the two non-impede states) by the mechanical assembly, acting by way of the locking mechanisms and the motive assembly. In actuality, although the position of the barrier in the impede state is referred to as Vertical, that is a relative term since, in the context of the invention, Vertical means a position where the barrier is sufficiently raised to prevent or discourage a vehicle from passing over it. More specifically, in the preferred embodiment of the invention, Vertical is approximately 75 degrees from the Ramp position of FIG. 1*c*.

FIG. 1*b* shows the barrier parking apparatus 200 after the various components within the mechanical assembly have released shaft 1 thereby allowing barrier 100 to fall of its own weight. Barrier 100 comes to a stop essentially horizontal, where the barrier top 103 is still somewhat raised above the roadbed. This state of barrier 100 in this position will be referred to as Horizontal. In the Horizontal state, barrier 100 no longer impedes vehicle entry and the vehicle may be driven over barrier 100. Once again, Horizontal is a relative term and generally refers to a position where the vehicle can drive over the barrier yet where the barrier is somewhat raised above the ground. Thus in actuality, in the Horizontal position the barrier is not truly "horizontal" but is at a slight upward angle.

FIG. 1*c* shows the barrier parking apparatus 200 after a vehicle has driven over barrier 100. The barrier is now slightly inclined, and is locked in this position. The top 103 of barrier 100 is essentially resting, or close to, the roadbed. This state of the barrier in this position will be referred to as Ramp. In the preferred embodiment, while this position is also relative, it is approximately 10 degrees from the position of the barrier in its Horizontal position. Thus in actuality, in the Ramp position the barrier is horizontally oriented.

Figure 2:
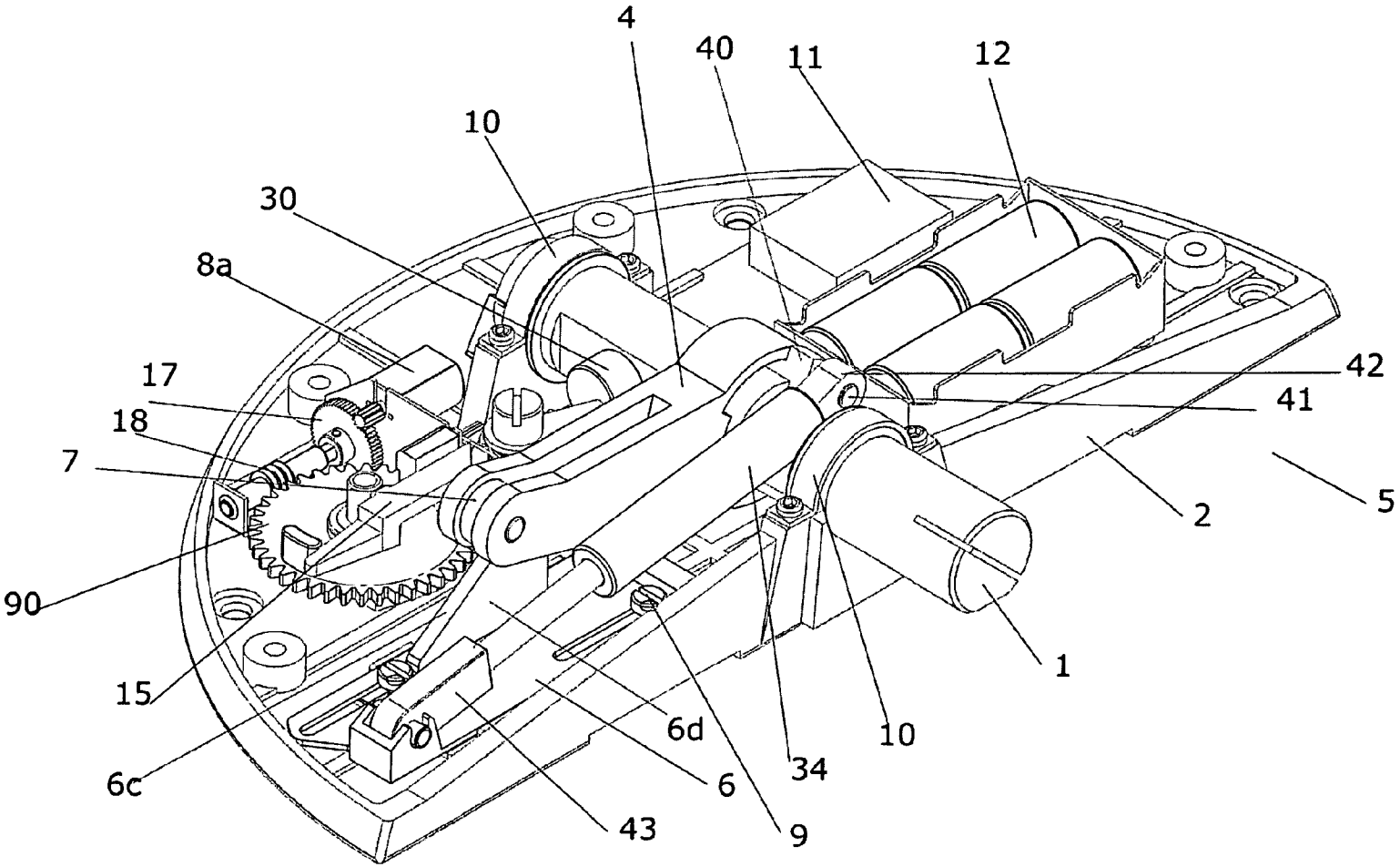
FIG. 2 is a top perspective view of the mechanical assembly of the parking barrier apparatus of our invention (with certain parts removed to facilitate an understanding thereof)

FIG. 2 shows the various components of the mechanical assembly 5 (with the cover thereof removed). The relative position of the various components does not necessarily represent an actual state of the assembly, as it was drawn to facilitate maximum visibility of the various parts. Shaft 1 is free to rotate along its longitudinal axis on two bearings 10. An offset lug 41 is rigidly attached to shaft 1 through lug shaft 40 so that, on rotation of shaft 1, the lug will rotate concentrically around the shaft's axis. A motive assembly, including an energy storage device in the form of spring 34 is attached to lug 41 through clevis 42. The clevis is an integral part of spring 34, and has a clearance hole allowing it to rotate freely around lug 41. In the preferred embodiment, spring 34 is a gas-filled strut that provides a relatively flat compression-to-force ratio. Furthermore, the gas-filled spring has built-in damping that slows the rate of travel of its piston when the spring expands, that is, the gas spring dampens the movement of the barrier as the barrier moves from its Ramp position to its Vertical position. The other end of spring 34 is connected to a slide 6 through clevis 43.

Slide 6 can move freely on the base 2 of the mechanical assembly in a direction perpendicular to the axis of shaft 1, as guided by shoulder bolts 9 which fit within slots in the slide. With shaft 1 stationary, as the slide moves towards the shaft, spring 34 will compress as the distance between the spring's two devises is reduced by the motion of the slide. Likewise, with slide 6 locked in place, rotation of shaft 1 in a counter-clockwise ("CCW") direction (as viewed looking at shaft 1 from the right of FIG. 2) will compress spring 34. In general, spring 34 compresses or extends whenever there is relative motion between shaft 1 and slide 6. As will be explained, because spring 34 is not anchored to base 2, both ends of the spring (represented by clevis 42 and clevis 43) are capable of moving relative to the base. The motive assembly includes an arm 4 which is mounted on shaft 1 through an arrangement that allows the arm to move freely on the shaft for about 135 degrees of rotation. Beyond this range of freedom, rotating shaft 1 clockwise ("CW") forces arm 4 to rotate CW, and rotation of shaft 1 CCW forces the arm to rotate CCW (down). The same applies in reverse—beyond the 135 degree freedom range, rotating arm 4 CCW will force shaft 1 to rotate CCW, and rotating the arm CW will force the shaft to rotate CW. While arm 4 could be fixed to shaft 1, this would require that the mechanical assembly 5 be of a height to accommodate arm 4 in a vertical position. Such a high profile is not desirable for the mechanical assembly, as a much lower profile enables the vehicle to pass over the assembly, if necessary.

Arm 4 is rotationally linked to slide 6 through a roller 7 that rests against inclined surface 6*c* of slide 6. Slide surface 6*c* is the leading edge of a triangle 6*d* that is an integral part of the slide. As slide 6 moves in the direction away from shaft 1, triangle surface 6*c* will raise arm 4 through roller 7. Likewise, if arm 4 is rotated CCW by shaft 1, roller 7 will exert a force on triangle 6*d* to move it towards the shaft. Thus a CCW rotation of shaft 1 will cause arm 4 to rotate CCW, which will cause spring 34 to compress, due to the relative motion of clevis 42 and clevis 43 which will move towards each other. It therefore follows that a CCW rotation of shaft 1 will compress spring 34. In the preferred embodiment, the triangle has a 43 degree angle, arm 4 is about 6 inches long, and the center of pin 41 is approximately 0.8 inches from the axis of shaft 1. With such a construction, a CCW rotation of 10 degrees of shaft 1 causes spring 34 to compress by about 1.2 inches.

If slide 6 is locked in the above position where it was forced by the CCW rotation of the shaft, spring 34 will exert a compressed force on the shaft through clevis 42 and pin 41. If the resisting force on the shaft is less than the force of the spring, shaft 1 will be forced to rotate CW until spring 34 is fully extended.

Thus, arm 4 (part of the motive assembly) functions to provide a mechanical gain, so that a relatively small CCW rotational movement of shaft 1 will create a relatively large linear movement of slide 6 so as to compress spring 34. In the preferred embodiment, a 10 degree CCW rotation of the shaft 1 as the barrier is moved from the Horizontal position to the Ramp position, will compress spring 34 by an amount of travel that will be sufficient to rotate the shaft 1 approximately 75 degrees CW from the Ramp position, thereby moving the barrier from the Ramp position to the Vertical position. From a rotational point of view, there is a 7.5:1 mechanical gain through the described arrangement.

Shaft 1 and slide 6 are selectively locked in place through an appropriate locking mechanism, in the form of two latches that are best viewed in subsequent figures. The latches (a shaft latch 15 and a slide latch 3) are released through a DC motor 8*a* which rotates gear 90 through two intermediary gears 17 and 18. The motor 8*a* is activated by controller 11 which is powered by batteries 12. The controller has a built in radio receiver, and accepts commands from a remote radio transmitter in a manner well known in the art.

By having most of the operative apparatus within mechanical assembly 5, sealing of the apparatus against inclement weather is made relatively easy, as the device needs be sealed only where shaft 1 exits the housing of which base 2 is one half (the other half being a cover, not shown herein). Moreover, with the apparatus of the present invention, various barriers can be used, thereby facilitating manufacturing, since assembly 5 and bearing assembly 101 can accommodate barriers of different lengths or constructions (such as a barrier with tines) as required.

Figure 3:
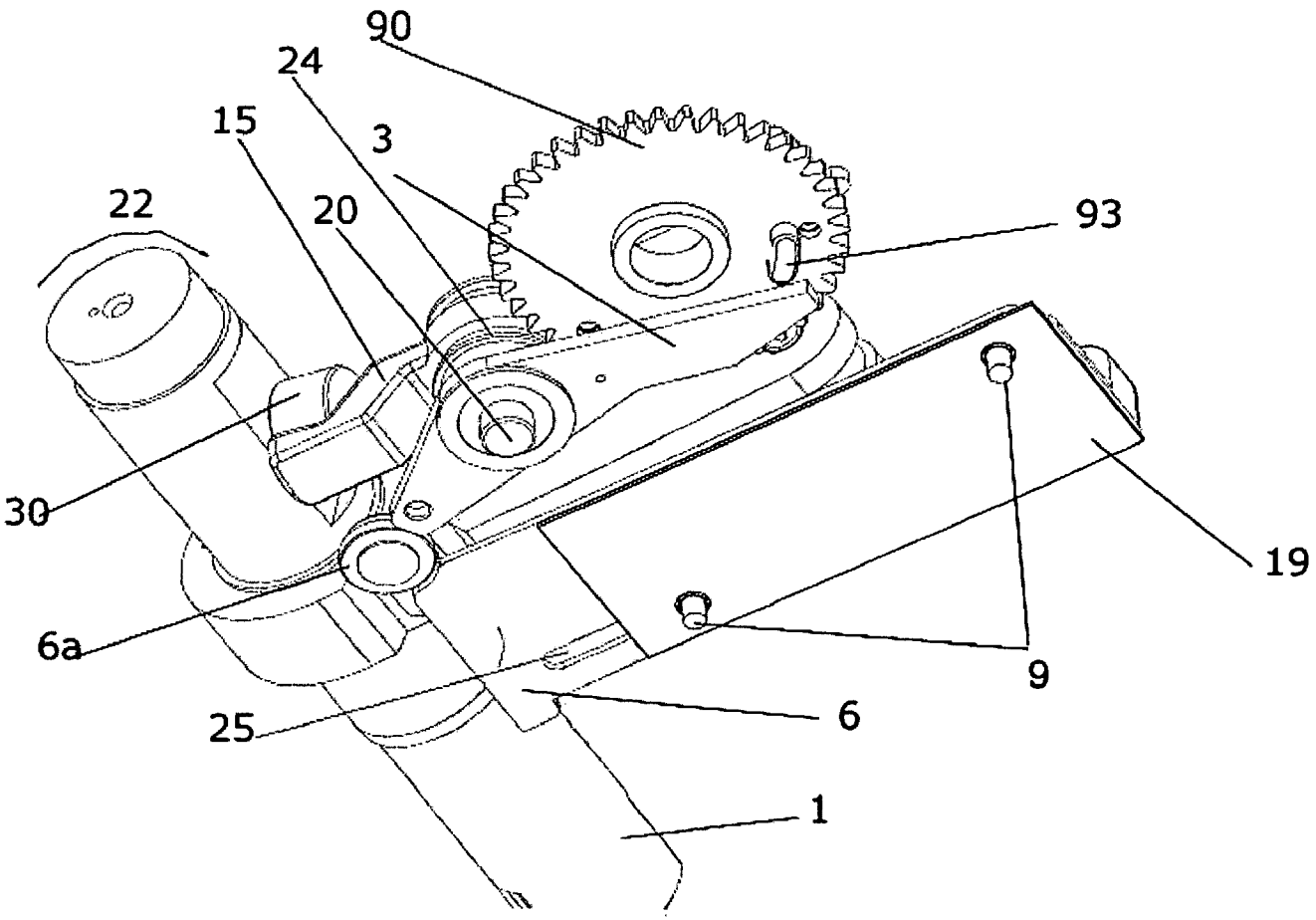
FIG. 3 is a simplified bottom perspective view of the mechanical assembly, with the output shaft and slide in a locked state, and the barrier in said Vertical position.

FIG. 3 is a simplified view of the locking mechanism. The view is from underneath the assembly, as if the base were transparent. The mechanism is shown with both shaft 1 and the slide 6 in locked positions.

More particularly, shaft latch 15 is mounted on the assembly base through a vertical post 20, and is free to rotate horizontally around this post. Roller 30 is mounted to shaft 1 in a manner that allows the roller to rotate freely along an axis that is radial to the axis of shaft 1. Such an arrangement is well documented in the art, and is often referred to as a cam follower. In FIG. 3, shaft latch 15 is shown in its locked position, where the latch is positioned under cam follower 30. Any attempt to rotate shaft 1 in direction 22 will be stopped by shaft latch 15.

As previously explained, slide 6 can move in a plane perpendicular to the axis of the shaft, as defined by the two bolts 9 which are located within slots 25. A low-friction pad 19 is provided to reduce the friction between slide 6 and the base 2 of the mechanical assembly. The slide 6 is prevented from moving away from shaft 1 by a slide latch 3 which is blocking a roller 6*a* from passing by it. Roller 6*a* is an integral part of slide 6 and is attached to it in a manner that allows the roller to rotate freely on a vertical axis, but it moves with the slide on a horizontal plane. Slide latch 3 rotates freely on post 20.

Gear wheel 90 rotates CW (as seen from the bottom) on a vertical post (not shown in FIG. 3). As it does, tab 93 forces slide latch 3 to rotate CW (as seen from the bottom) until the other end of the latch 3 breaks contact with the roller 6*a*. This frees slide 6 to move away from shaft 1.

Figure 4:
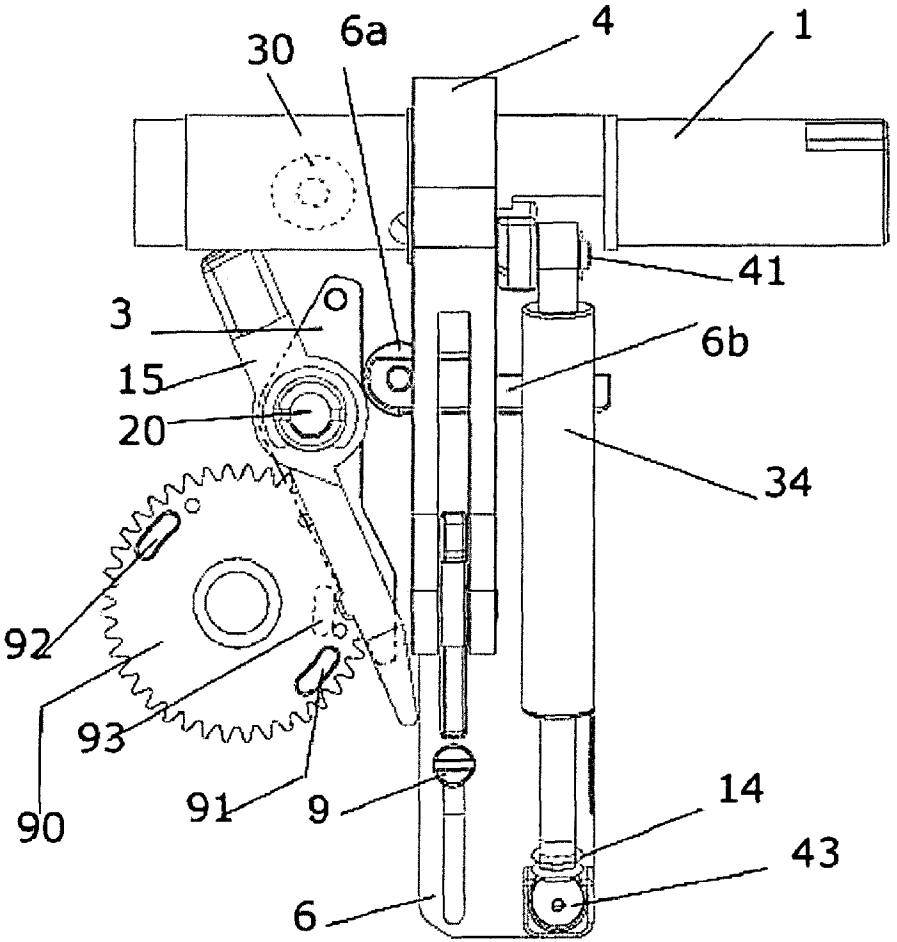
FIG. 4 is a simplified top view of the latch mechanism used in the mechanical assembly, with the output shaft and the slide unlocked, and the barrier in said Horizontal position.

FIG. 4 is a simplified top view of the mechanical assembly, with emphasis on the locks for the shaft and for the slide. The assembly is shown in a state when neither shaft 1 nor slide 6 is locked which corresponds to the barrier being in its Horizontal position. The two latches that form the locks are shaft latch 15 for the shaft lock and slide latch 3 for the slide lock. Both rotate freely on post 20 which is firmly affixed to the base 2 of the assembly. Gear 90 is shown in a position where tab 93 (located below wheel 90 and thus shown in dashed line in this view), has forced latch 3 CCW to the point where slide 6 was able to travel past it, away from the shaft 1. Likewise shaft latch 15 has rotated CCW where it no longer impedes the travel of roller 30 and thus shaft 1 is free to turn. Shaft latch 15 is forced CCW by either tab 91 or tab 92 on the gear wheel 90. These two tabs are 180 degrees apart. Thus every one half rotation of wheel 90 releases shaft latch 15, but a full rotation is required to release slide latch 3.

Figure 5:
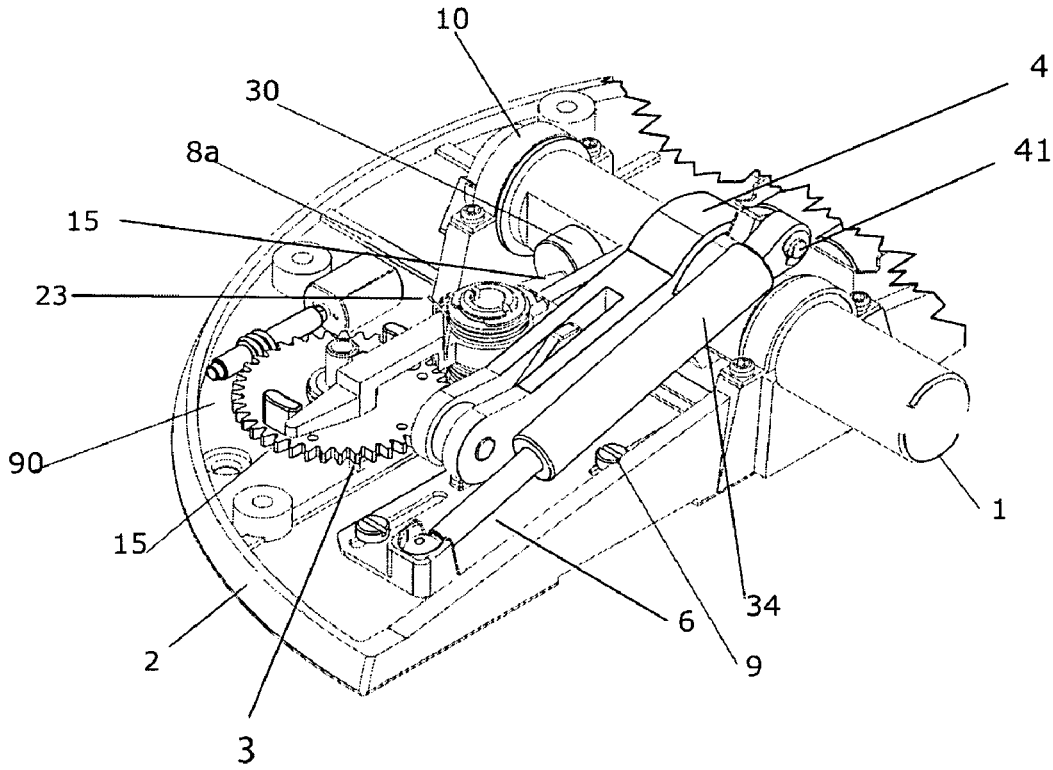
FIG. 5 is a simplified perspective view of the latch mechanism with both the output shaft and the slide locked, and the barrier in said Vertical position.

FIG. 5 is a simplified perspective view of the mechanical assembly, once again with emphasis on the locking mechanisms for the slide and the shaft, but this time showing both slide 6 and shaft 1 locked. Thus, slide 6 is locked in the forward position and shaft 1 is locked such that the barrier is maintained in the Vertical position. In this position the barrier is in the impede position, and is prevented from falling by shaft latch 15 blocking roller 30. For its part, slide 6 is locked by slide latch 3 (partially visible under wheel 90). The forward position of slide 6 can be discerned by the fact that slot 25 is mostly forward of guide bolt 9. Also visible in this view are the return springs 23 and 24. These springs tend to return latches 15 and 6, respectively, to their CW (locked) positions. The latches are thus self latching, and will rotate into their respective and individual locked position when there is no interference in their respective paths. The latches are forced out of the lock position by the tabs on wheel 90.

Figure 6:
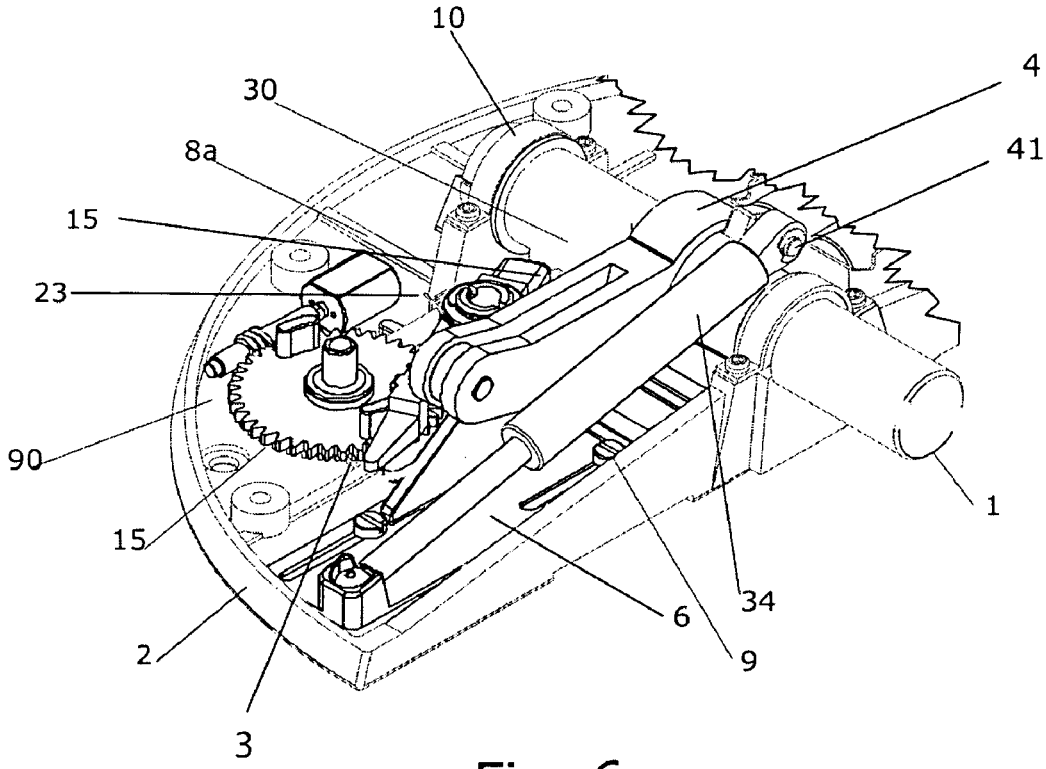
FIG. 6 is a simplified perspective view of the latch mechanism, in a state where neither the output shaft nor the slide is locked, the barrier being in said Horizontal position.

FIG. 6 is a simplified perspective view of the mechanism with the slide in its back-most position and the shaft, unlocked, is in the state that corresponds to the barrier being in Horizontal position (see FIG. 1*b*). The slide is at its furthermost stop (limited by the end of the slot hitting bolt 9). In the position illustrated in FIG. 6, arm 4 (which provides the mechanical gain to compress spring 34, upon only a relatively small movement of the shaft) is raised to its highest position at the top of the triangle 36. Spring 34 is fully extended.

Figure 7:
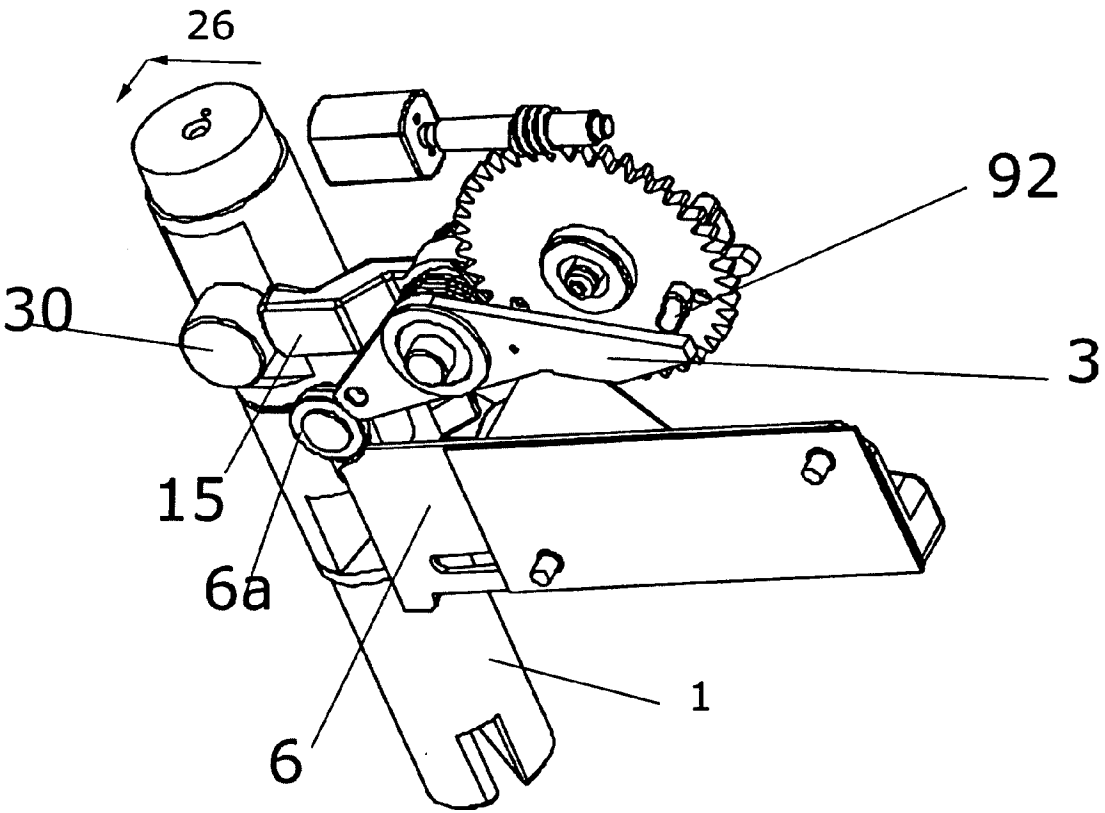
FIG. 7 is a simplified bottom perspective view where the barrier is locked in its Ramp position.

FIG. 7 is a simplified perspective view of the assembly as seen from underneath, in the Ramp position. Roller 30 is prevented from rotation in direction 26 through the front surface of shaft latch 15, thus preventing the shaft 1 from rotating and its attached barrier from rising. Slide 6 is prevented from moving backwards by slide latch 3 which blocks roller 6*a*.

Figure 8:
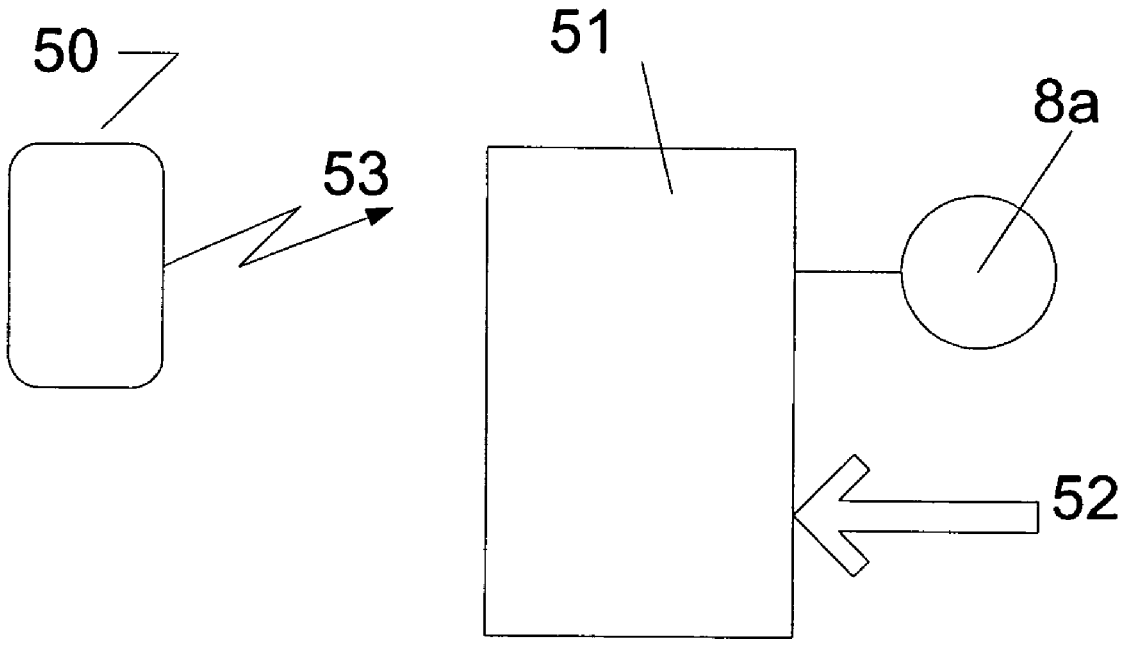
FIG. 8 is a is a simplified block diagram view of the electronic control of the parking barrier apparatus of our invention.

FIG. 8 is a simplified block diagram of the electronic control of the apparatus. Radio transmitter 50 transmits an encoded signal 53 when a button on the transmitter is depressed. Controller 51 incorporates a radio receiver. When the signal is received and authenticated, the controller activates the motor 8*a* by providing it with power. A sensor 52 (such as a opto-sensor) monitors the rotation of wheel 90 (FIG. 2) and stops the power to the motor when the wheel has rotated 180 degrees. Every transmission from transmitter 50 will likewise activate motor 8*a* and allow wheel. 90 to rotate 180 degrees. The rotation of the wheel releases either the slide latch 3 or both the slide latch 3 and the shaft latch 15, depending whether the wheel is in a position where both tabs on the bottom and the top engage their respective latches, or only the upper tab engages the shaft latch.

Figure 9:
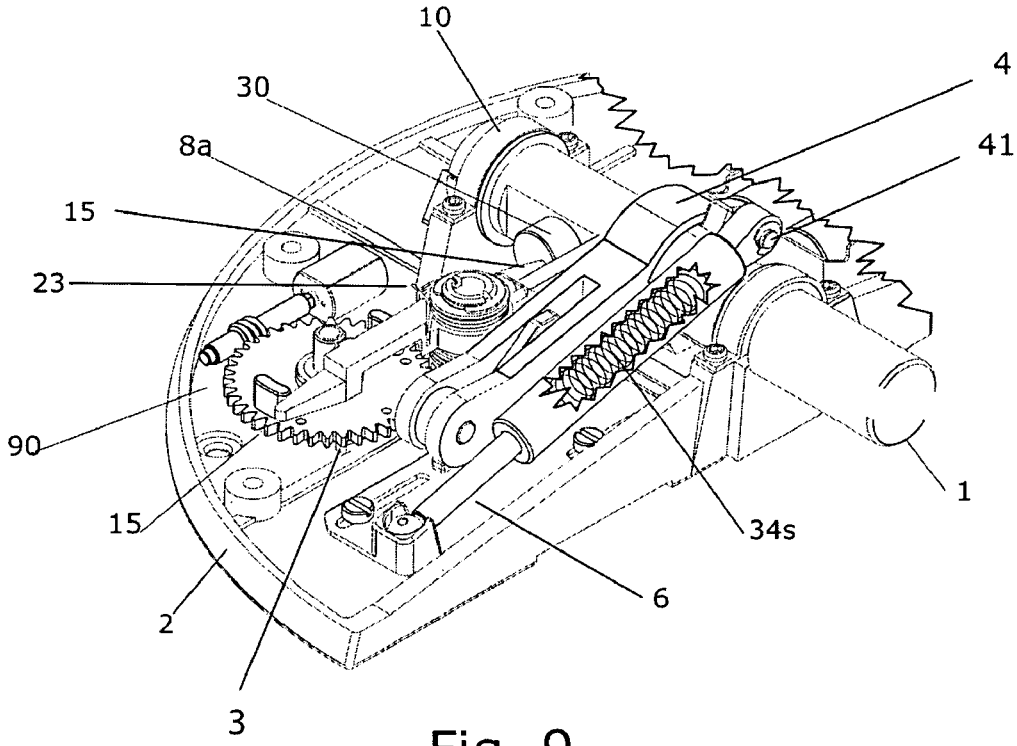
FIG. 9 is a simplified perspective view of the latch mechanism with both the output shaft and the slide locked, and the barrier in said Vertical position according to an alternative embodiment of the present invention.

FIG.9 is a simplified perspective view of the mechanical assembly, substantially identical to the view of FIG. 5, but showing an alternative embodiment of the present invention utilizing a spring 34*s*.

The operation of the mechanism is best understood when started at the Vertical state, where the barrier impedes access, as seen in FIG. 1*a*.

SEQUENCE OF OPERATION

Vertical to Horizontal: The state of the mechanism when the barrier is locked in the Vertical state is shown in FIG. 5. In this position, shaft latch 15 prevents roller 30 from rotating past it, and thus prevents shaft 1 from rotating CCW. Shaft rotation in the CW direction is blocked by a physical stop (not shown) in the base that prevents lug shaft 40 from moving past that position. Spring 34 is slightly compressed as will become evident when the last step in the sequence is reviewed.

When it is desired to change the state of the barrier from its impeded (Vertical) position to the Horizontal position, to allow traffic over the apparatus, motor 8A is activated. As wheel 90 turns, tab 91 on the top of the wheel pushes against shaft latch 15 and rotates it away from the path of roller 30. With additional reference to FIG. 3, simultaneously, tab 93 under wheel 90 presses against slide latch 3 and rotates it away from the path of slide roller 6*a*. Slide 6 is now free to move. Slide 6 will move back somewhat until the spring 34 is fully extended, as there no longer is a force to resist this compressed force which has been trapped between the locked shaft and the locked slide.

The barrier, when in Vertical, is actually about 15 degrees from a vertical plane. In other words, the barrier is not truly vertical in this position, and thus it has a component of torque in relationship to the shaft that exerts torque on shaft 1 to rotate CCW. With the shaft 1 and the slide 6 free to move, the torque from the barrier causes the shaft to rotate CCW and the slide is pushed away from the shaft through spring 34. The resisting force of the spring 34 far exceeds the friction force on the slide, and thus the torque generated by the falling barrier is transmitted to the slide through the extended spring 34. The barrier and the slide come to a stop in the Horizontal state, shown in FIG. 4. It is noted that in order for the barrier to move from the Vertical position to the Horizontal position, neither shaft 1 nor shaft 6 can be locked. That is, the locking mechanisms for the shaft and for the slide must be disabled. This is accomplished by releasing shaft latch 15 and slide latch 3, respectively. A separate damper (not shown) can be provided to dampen the movement of the barrier from its Vertical to its Horizontal position.

Horizontal to Ramp: With reference to FIG. 4 and FIG. 6, the shaft is prevented from CCW rotation by arm 4 resting against triangle 36 on slide 6. In order for the arm to move further CCW, triangle 36 has to move towards shaft 1. This requires spring 34 to compress, which demands more force than is exerted by the barrier's own weight on the shaft. The shaft is in effect free to rotate if adequate force is applied to the barrier, but stays in its Horizontal position until such force becomes present.

When a vehicle drives over the barrier, shaft 1 rotates CCW. Arm 4 likewise rotates CCW, applying force against triangle 36 of slide 6. This forces the slide 6 to move towards the shaft 1, which in turn compresses spring 34. As slide 6 moves forward (best viewed on FIG. 4) towards the shaft 1, roller 6*a* passes the edge of latch 3. Slide latch 3 is now free to rotate CW and, forced by spring 23 (viewed in FIG. 5), will rotate behind roller 6*a*. The slide latch thus reaches a position where it locks slide 6 in place.

Likewise, the CCW rotation of shaft 1 rotates roller 30 to the point where shaft latch 15 is free to rotate CW as the roller no longer is in its path. The shaft latch 15 will move into a position behind roller 30 through the return force action of spring 24 as seen in FIG. 7. The shaft latch thus reaches a position where it locks shaft 1 in place.

Once the vehicle has driven over the barrier and its weight no longer keeps the barrier down, the force of the compressed spring 34 will attempt to rotate the shaft 1 CW and to force the slide 6 backwards from the shaft. As both the shaft 1 and the slide 6 are locked in place in this state, the barrier stays down in the Ramp position and spring 34 is kept compressed, storing the energy for future use.

Thus, in moving from the Horizontal position to the Ramp position, spring 34 is compressed. This is accomplished by rotating shaft 1 CCW (which compresses the end of the spring nearest the shaft) and by moving the slide 6 toward the shaft (which compresses the other end of the spring furthermost from the shaft in the opposite direction).

Ramp to Vertical: With reference to FIG. 5, when it is desired to raise barrier 1 back to its impede position or Vertical position, motor 8A is activated. The motor rotates wheel 90 for 180 degrees. During this rotation, tab 91 forces shaft latch 15 to rotate CCW, which frees shaft 1 to rotate CW. The stored energy in spring 34 now forces the shaft to rotate CW, lifting the barrier with it. The shaft 1 will rotate until it hits a mechanical stop (not shown) which defines the Vertical angle of the barrier. This returns the apparatus to the Vertical position, and the operational cycle as described herein has been completed. In this regard, it is noted that to go from the Ramp position to the Vertical position, only shaft latch 15 is released. Slide latch 3 continues to keep slide 6 locked. By using a gas spring 34 (commercially available of the type used in the automotive industry) the movement of the barrier from the Ramp to Vertical position is dampened and a controlled movement is provided.

In summary, the invention thus includes the steps of locking the barrier in its Vertical position (against a bias force, such as gravity); unlocking the barrier (for example by using a remote control device) so that it moves under the influence of the bias force to its Horizontal position; maintaining the barrier in its Horizontal position until sufficient force is applied to the barrier to move it to its Ramp position; energizing an energy storage device, such as a spring, as the barrier is moved from the Horizontal to the Ramp positions, for example by having the vehicle drive over the barrier; providing sufficient energy in the spring to eventually enable the spring to move the barrier from the Ramp to the Vertical position against the action of the bias force; locking the barrier in the Ramp position with the storage device energized until it is desired to move the barrier from its Ramp position to its Vertical position; and unlocking the barrier (for example by a remote control device) from its Ramp position to allow it to move to the Vertical position.

Although the invention has been described with respect to a preferred embodiment, modifications, additions and variations will become evident to those of ordinary skill in the art. Certain terminology used in the description of our invention should not be construed to be restrictive to a particular shape or similar means to achieve a like outcome. For example, the term "barrier" used throughout this description could be readily interchanged with "gate" or "plate". Similarly, although the impede means has been described as a barrier, other ways of preventing access of a vehicle past the device may be used. For example, the barrier may take the form of a series of tines to discourage a car from passing over it.

In the preferred embodiment, for example, the barrier impede position is about 15 degrees off the true vertical, and the force of gravity acts as a bias to lower the barrier once the appropriate locking mechanism is released. If it is desired for the barrier to be fully vertical then another bias force should be provided. This force (which tends to move shaft 1 CCW), could be provided by a separate biasing spring. Alternatively, the barrier could be "weighted" in an offset fashion, to likewise provide the CCW torque.

Yet further, although we have described using a gas spring as the motive element, we could use a compression spring (and provide separate dampening, if desired). The slide that controls the movement of one end of the spring can be replaced by a cable that runs through a mandrel in the center of the spring and it attached to the shaft. In that case, the side of the spring close to the shaft is compressed through a cam in a way that provides the desired mechanical gain. Similarly, we could have substituted a hydraulic control by utilizing hydraulic valves instead of mechanical latches in order to lock and unlock the shaft and the slide.

For applications where it is desirable to have a smooth entry into the parking space or the driveway, the surface mounted design of the invention can be readily modified to be installed in a recess in the surface, so that, when the barrier is in the Ramp position, it would be flush with the surface of the roadway.

The design of the device can be altered to accommodate an extension spring or a torsion spring to replace the functionality of spring 34 which is described in the preferred embodiment as an compression gas spring.

All such modifications, variations, additions and changes to terminology are intended to be encompassed within the scope of this invention. Thus, the description should be considered to be illustrative of the invention.

What is claimed is:

1. A parking barrier apparatus for controlling the access of a vehicle past a barrier comprising:

a barrier movable between a first barrier position allowing transit of the vehicle past said barrier, a second barrier position to which said barrier is moved by the passage of the vehicle over said barrier, and a third barrier position impeding movement of the vehicle past said barrier, said first barrier position being intermediate said second and third barrier positions;

a locking mechanism selectively locking said barrier in said second barrier position and said third barrier position; and a motive assembly having an energy storage device which stores mechanical energy to eventually move said barrier from said second barrier position to said third barrier position when said barrier is unlocked from said second barrier position, said energy storage device including a spring having a first spring end and a second spring end, said spring being energized by the weight of the vehicle moving over said barrier causing said barrier to move from said first barrier position to said second barrier position;

a housing for said motive assembly having a base;

a rotatable shaft operatively connected to said first spring end, rotation of said shaft moving said barrier;

a support movable with respect to said base, said second spring end operatively connected to said support, said support moving toward said shaft as said barrier is moved from said first barrier position to said second barrier position thereby enabling said spring to be energized sufficiently to eventually move said barrier from said second barrier position to said third barrier position.

2. A parking barrier apparatus according to claim 1 herein wherein said support is a platform movable on said base, and as said platform moves toward said shaft said spring is substantially compressed by moving said second spring end toward said first spring end.

3. A parking barrier apparatus according to claim 2 wherein said motive assembly further includes a mechanical gain amplifier for amplifying movement of said shaft into movement of said platform.

4. A parking barrier apparatus according to claim 3 wherein said mechanical gain amplifier includes an arm attached to said shaft and a riding surface attached to said platform for translating rotatable motion of said shaft into linear motion of said platform.

5. A parking barrier apparatus according to claim 4 wherein said arm is operatively attached to said rotatable shaft and said arm has a degree of freedom of movement relative to said shaft over a predetermined rotation of said shaft.

6. A parking barrier apparatus according to claim 1 wherein said spring includes a damper which dampens movement of said barrier as said barrier is moved from said second barrier position to said third barrier position.

7. A parking barrier apparatus according to claim 6 wherein said spring is a gas spring.

8. A parking barrier apparatus according to claim 1 wherein said locking mechanism includes a shaft locking mechanism for selectively locking said shaft to prevent rotation of said shaft in one direction.

9. A parking barrier apparatus according to claim 8 wherein said shaft locking mechanism includes a latch lock which self-latches once said shaft reaches a locking position.

10. A parking barrier apparatus according to claim 9 wherein said locking mechanism further includes a motor controlling operation of said latch lock.

11. A parking barrier apparatus according to claim 10 wherein said locking mechanism further includes a gearing assembly movable by said motor to unlock said latch lock.

12. A parking barrier apparatus according to claim 11 wherein said locking mechanism is remote controlled.

13. A parking barrier apparatus according to claim 2 wherein said locking mechanism includes a platform locking mechanism selectively locking said platform to prevent movement of said platform in one direction relative to said base.

14. A parking barrier apparatus according to claim 13 wherein said platform locking mechanism includes a latch lock which self-latches once said platform reaches a locking position.

15. A parking barrier apparatus according to claim 14 wherein said locking mechanism further includes a motor for controlling said latch lock.

16. A parking barrier apparatus according to claim 15 wherein said locking mechanism further includes a gearing assembly movable by said motor which selectively unlocks said latch lock.

17. A parking barrier apparatus according to claim 16 wherein said locking mechanism is remote controlled.

18. A parking barrier apparatus for controlling the access of a vehicle past a barrier comprising:

a barrier movable between a horizontal position allowing transit of the vehicle thereover, a lower ramp position also allowing transit of the vehicle thereover, and a vertical position preventing transit of the vehicle thereover, said barrier being adapted to move from said horizontal position to said ramp position by the weight of the vehicle passing thereover;

a housing having a base;

a shaft operatively connected to and moving said barrier;

a locking mechanism for selectively locking said shaft with said barrier in said ramp position or with said barrier in said vertical position; and a motive assembly for moving said shaft including a spring having a first end and a second end, said first spring end operably connected to said shaft and said second spring end fixedly connected to a support movable with respect to said base, said spring as said barrier is moved from said horizontal position to said ramp position under the weight of the vehicle moving thereover storing sufficient mechanical energy subsequently to move said barrier from said ramp position to said vertical position, by having said second spring end and support move with respect to said base, neither of said ends of said spring being permanently anchored to said base.

19. A parking barrier apparatus according to claim 18 wherein said spring is mounted on a platform movable with respect to said base.

20. A parking barrier apparatus according to claim 19 wherein said platform moves toward said shaft as the barrier is moved from said horizontal position to said ramp position, said movement substantially compressing said spring.

21. A parking barrier apparatus according to claim 20 wherein said motive assembly further includes a mechanical gain amplifier for amplifying movement of said shaft into movement of said platform.

22. A parking barrier apparatus according to claim 21 wherein said mechanical gain amplifier includes an arm attached to said shaft and a riding surface attached to said platform for translating rotatable motion of said shaft into linear motion of said platform.

23. A parking barrier apparatus according to claim 22 wherein locking mechanism prevents movement of said shaft in at least one direction and prevents movement of said platform when said barrier is in said vertical position.

24. A parking barrier apparatus according to claim 23 wherein said locking mechanism includes latch locks for each of said shaft and said platform.

25. A parking barrier apparatus according to claim 24 wherein said locking mechanism further includes a motor operable to selectively release said latch locks.

26. A parking barrier apparatus according to claim 25 wherein said locking mechanism further includes a controller for controlling operation of said motor.

27. A parking barrier apparatus according to claim 22 wherein said spring is a gas spring.

28. A parking barrier apparatus according to claim 27 wherein said gas spring dampens movement as said barrier is moved from said ramp position to said vertical position.

29. A method for sequencing movement of a parking barrier, the barrier movable with respect to a base and having a vertical vehicle impede position, a non-impede horizontal position and a lower non-impede ramp position, comprising the steps of:

locking said barrier in said vertical position against a bias force which would otherwise move said barrier;

unlocking said barrier so that said barrier moves under the influence of said barrier force to said horizontal position;

maintaining said barrier in said horizontal position until sufficient force is applied to said barrier to move it to said ramp position;

energizing a spring having a first spring end and a second spring end as said barrier is moved from said horizontal position to said ramp position;

providing sufficient energy in said spring by having said second spring end move relative to said first spring end and move relative to the base to eventually enable said spring to move said barrier from said ramp position to said vertical position against the action of said bias force;

locking said barrier in said ramp position with said spring energized until it is desired to move said barrier from said ramp position to said vertical position; and unlocking said barrier from said ramp position to allow it to move to said vertical position.

30. A method according to claim 29 wherein said spring is energized by the weight of a vehicle as the vehicle moves the barrier from said horizontal position to said ramp position.

31. A method according to claim 30 further comprising the step of providing a command signal to unlock said barrier from said vertical position.

32. A method according to claim 31 further comprising the step of providing a command signal to unlock said barrier from said ramp position.

33. A method according to claim 30 further comprising the steps of providing control signals from a remote controller to unlock said barrier from said vertical position and from said ramp position.

* * * * *